United States Patent [19]

Einem

[11] Patent Number: 5,000,590

[45] Date of Patent: Mar. 19, 1991

[54] PRINT HEAD ADJUSTMENT MECHANISM

[75] Inventor: Robert E. Einem, Glendale, Calif.

[73] Assignee: ITT Corporation, New York, N.Y.

[21] Appl. No.: 373,744

[22] Filed: Jun. 29, 1989

[51] Int. Cl.[5] ..... B41J 11/20

[52] U.S. Cl. ..... 400/55; 400/59; 400/355

[58] Field of Search ..... 400/55, 58, 59, 56, 400/355, 356, 320

[56] References Cited

U.S. PATENT DOCUMENTS

| | | | |
|---|---|---|---|
| 4,277,189 | 7/1981 | Howard et al. | 400/55 |
| 4,381,896 | 5/1983 | Shiurila | 400/56 |
| 4,420,269 | 12/1983 | Ackermann et al. | 400/356 |
| 4,439,777 | 3/1984 | Aprato | 400/56 |
| 4,657,415 | 4/1987 | Kikuchi et al. | 400/355 |
| 4,720,200 | 1/1988 | Gomoll et al. | 400/56 |
| 4,774,529 | 9/1988 | Paranjpe et al. | 400/126 |
| 4,787,759 | 11/1988 | Geis et al. | 400/55 |
| 4,893,949 | 1/1990 | Limberger et al. | 400/59 |
| 4,906,115 | 3/1990 | Bischof | 400/55 |

FOREIGN PATENT DOCUMENTS

| | | | |
|---|---|---|---|
| 0049286 | 5/1981 | Japan | 400/59 |
| 0117677 | 9/1981 | Japan | 400/59 |
| 0071679 | 4/1987 | Japan | 400/354 |
| 0151364 | 7/1987 | Japan | 400/55 |
| 82/01513 | 5/1982 | PCT Int'l Appl. | 400/55 |

OTHER PUBLICATIONS

IBM Technical Disclosure Bulletin, vol. 27, No. 10B, Mar. 1985, "Slotted Bearing".

*Primary Examiner*—Edgar S. Burr
*Assistant Examiner*—John S. Hilten
*Attorney, Agent, or Firm*—Menotti J. Lombardi

[57] ABSTRACT

An adjustable shaft mechanism for adjusting the gap between a print head and a platen in a dot matrix printer has a printer frame with two end frame members and a fixed guide member. An adjustable shaft runs substantially parallel to the guide member between the end frame members. A print head carriage runs along the guide and shaft members. A substantially vertical slot in each of the end frame members is employed to adjust the adjustable shaft for movement up and down with respect to the end frame members. Spring loading means biases the shaft toward the guide member. A cam on each end member is mounted for rotation for adjusting the shaft in the slots to raise and lower the print head carriage and the associated print head with respect to the platen.

2 Claims, 2 Drawing Sheets

PRINT HEAD ADJUSTMENT MECHANISM

BACKGROUND OF THE INVENTION

1. Field of the Invention

This invention relates to adjustable shaft mechanisms for adjusting the gap between a print head and a platen by adjusting the height of the shaft on which the print head carriage rides with respect to the platen.

2. Description of the Prior Art

It is typical in all dot matrix impact printers that it is necessary to adjust the gap between the print head and the platen. This has typically been done by moving the carriage shaft on which the print head carriage rides. In the prior art this has been accomplished in at least two manners. One, a lever method in which the shaft is pivoted by a lever mechanism which is then locked in place with a locking screw. This method is inexpensive but offers a very small mechanical advantage and fine adjustment since it is only in the area of 3:1. Hence, adjustment of 0.001 inches of shaft position requires a critical movement of the lever end of 0.003 inches. Also, locking the levers in place with a screw requires the use of a tool. A second method employs a non-concentric shaft. This method provides for fine adjustment of the head gap, but the non-concentric shaft is costly to produce. Also, the vertical adjustment of the shaft is combined with the horizontal displacement which causes the print line to be shifted up or down on the page.

U.S. Pat. No. 4,746,233 discloses a printing apparatus of the type in which the adjustment mechanism of the present invention would be useful. See column 6, line 35 and following for the motion of the print head carriage.

In accordance with an aspect of the present invention, it is an object to provide a mechanism for adjusting the gap between a print head and a platen in a dot matrix printer by camming the adjustable shaft up and down using a cam on each end of the printer frame.

Another object is to provide spring loading between the adjustable shaft member and the fixed guide member upon which the printer carriage rides employing a spring biasing the shaft and guide member together, such that when printing takes place the force vector on the shaft is up and the shaft is maintained in position.

SUMMARY OF THE INVENTION

The foregoing and other objects are accomplished by providing an adjustable shaft mechanism for adjusting the gap between a print head and a platen in a dot matrix printer which has a printer frame with two end frame members. A fixed guide member and an adjustable shaft run substantially parallel between the end frame members, and a print head carriage runs along the guide member and the shaft. Substantially vertical slots in each end frame member provide for adjusting the adjustable shaft up and down with respect to the end frame members. Spring loading means bias the shaft toward the guide member, and a cam on each end member is mounted for rotation to adjust the shaft up and down in the slot and correspondingly move the print head up and down with respect to the platen.

Other objects, features and advantages of the invention will become apparent from a reading of the specification, when taken in conjunction with the drawings.

DETAILED DESCRIPTION OF PREFERRED EMBODIMENTS

Figure 1:
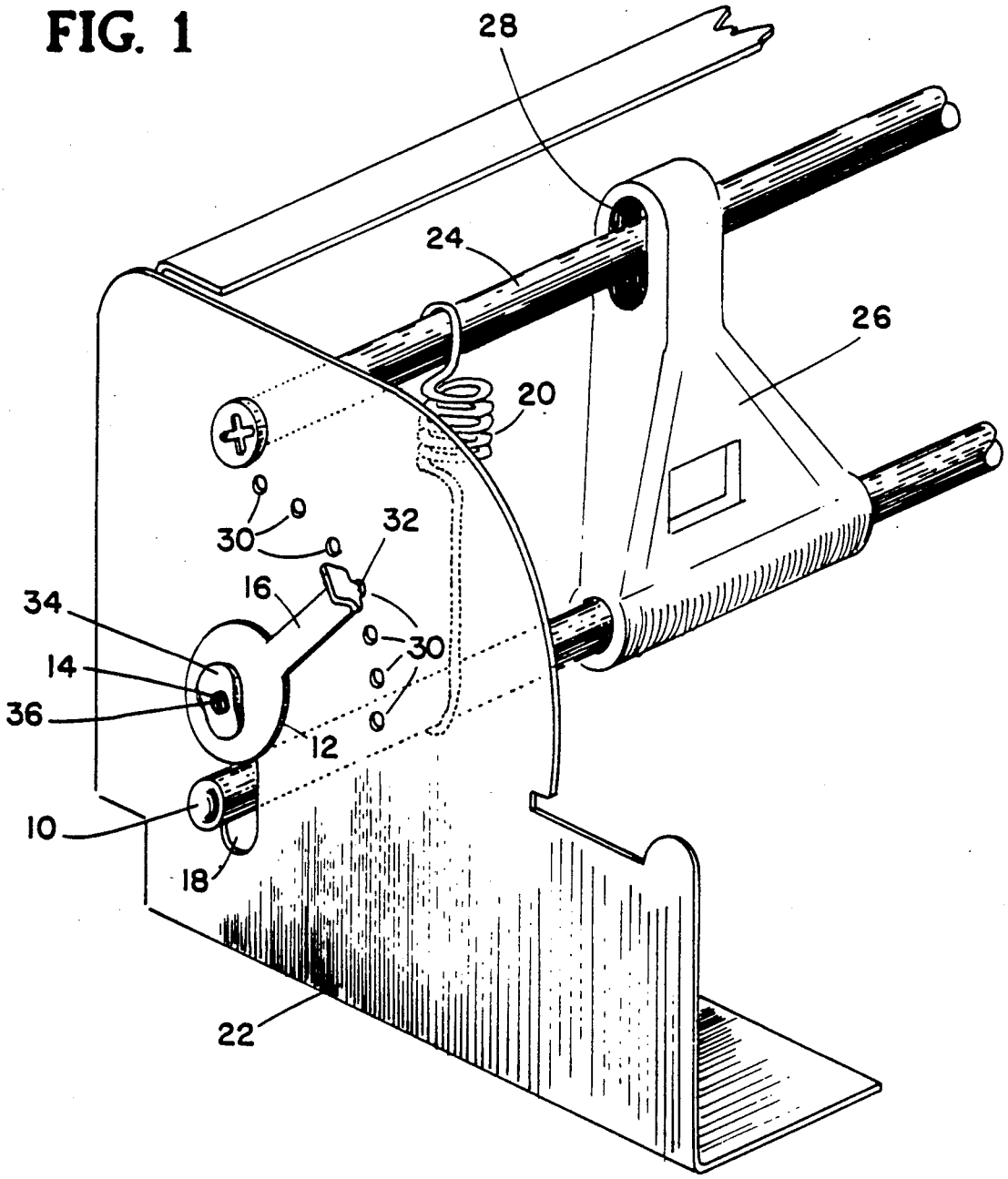
FIG. 1 is an isometric view of one end of a printer frame employing the adjustable shaft mechanism of the invention.

Turning to the drawings, the invention provides for fine adjustment of the shaft 10 of FIG. 1 in a single plane without costly parts. The cam 12 may be formed in an inexpensive manner, using a circular member having an offset mounting hole 14 of, for example, 0.021 inches, and provides a mechanical advantage of 172:1. Hence, it is simple to make a small change in the position of shaft 10 with a large motion of the cam lever handle 16. The ratio can easily be changed in design to whatever is most desirable.

Shaft 10 rides in a slot 18, and therefore is only displaced in a single plane up and down. Shaft 10 is spring loaded upward against the cam 12 with a tension spring 20 on each end of the printer frame. The end of the frame 22, illustrated in FIG. 1, is similar to the opposed frame end, not illustrated. The tension spring 20 is shown between the shaft 10 and a fixed guide member 24, shown in this embodiment to be a shaft. The guide member 24 could also be a flange extending downward from the top of the printer enclosure. Spring member 20 is shown outward from the end of the frame 22 (for illustrative purposes). However, it is obvious that to keep it out of the way of the movement of the print head carriage 26, it would be positioned close to the printer frame end 22.

The print head carriage 26 moves back and forth along the fixed guide member 24 and the adjustable shaft 10, and can move up and down with up and down adjustment of shaft 10 due to the slot 28 in the print head carriage. This slot would be replaced by a yoke if a flange from the top of the printer frame were employed.

The invention involves the fact that the shaft does not have to be fixed in place as long as its upward travel is blocked at the proper location and it is spring loaded against the cam member. The force vector on the shaft when the print wires are struck is up and maintains the shaft in position, preventing chattering.

Holes 30 are provided in the end frame member 22 to provide for incremental motion of the cam lever 16 such that the projection 32 on the end of the cam lever 16 can extend into the holes 30. The projection 32 is biased into the holes 30 by using a spring washer 34 under the shoulder screw 36, around which cam 12 rotates, in order to bias the cam inwardly against the printer frame and member 22. Each step between the holes 30 can provide a change of approximately 0.002 to 0.0025 inches of shaft displacement, for example.

Hence, the adjustment of the adjustable shaft 10 and the corresponding adjustment of the print head with respect to the platen is simplified by the fact that tools, such as a screwdriver, are not required to make the adjustment.

Figure 2:
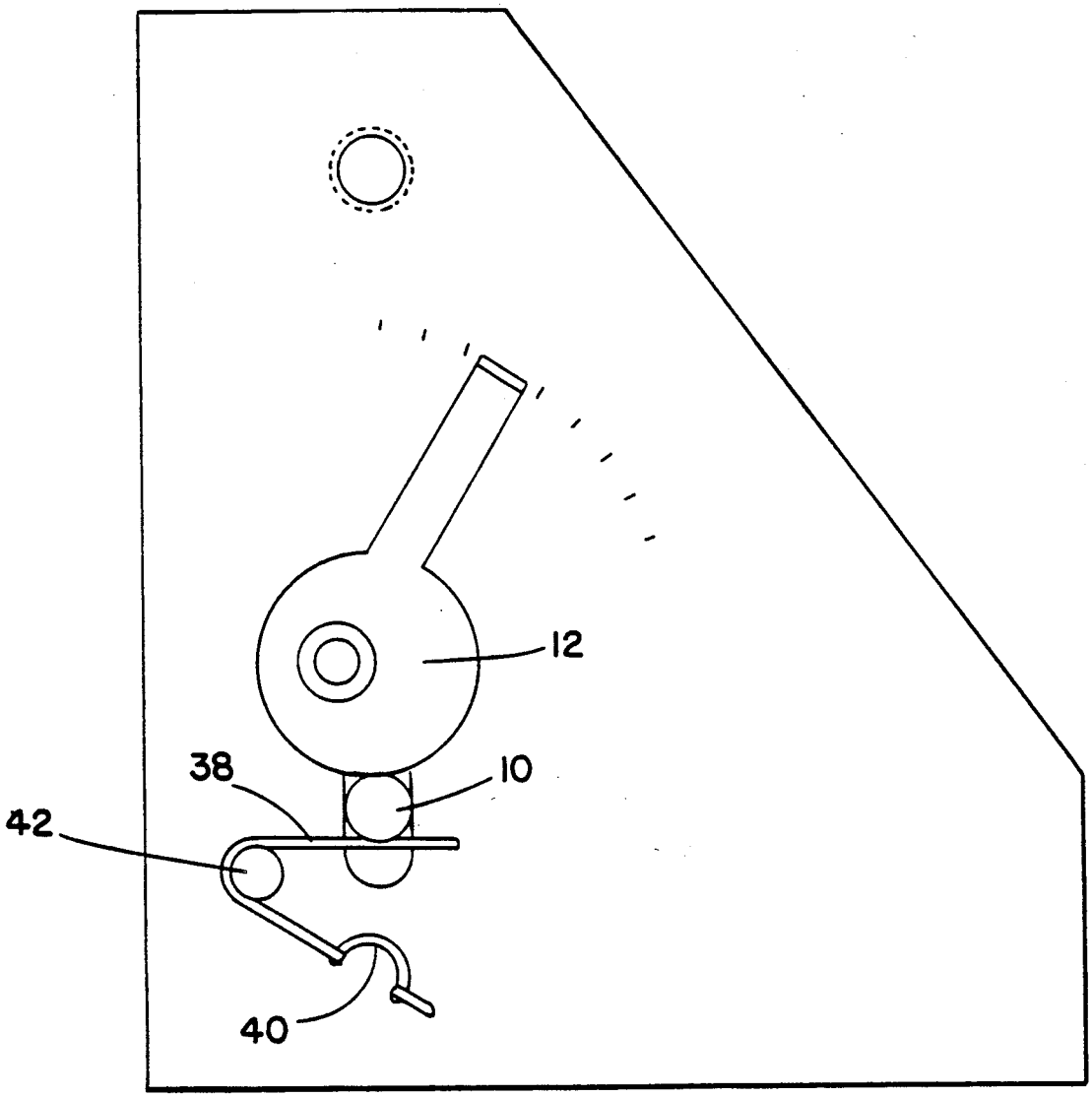
FIG. 2 is an end view of a second embodiment employing a different spring biasing mechanism for adjusting the adjustable shaft.

FIG. 2 illustrates a second method of spring biasing the adjustable shaft 10 upwardly against the cam 12 by employing a hairpin spring 38, which has one end stopped in a slot 40, its center running around a pivot pin 42, and its other end biased against the adjustable shaft 10, forcing it upwardly against the cam.

While particular embodiments of the invention have been shown, it will be understood of course that it is not intended to limit the invention thereto, since many modifications can be made. It is therefore contemplated by the appended claims to cover any such modifications as fall within the true spirit and scope of the invention.

I claim:

1. An adjustable shaft mechanism for adjusting the gap between a print head and a platen in a dot matrix printer comprising in combination:

a printer frame having two end frame members, a fixed guide member and an adjustable shaft running substantially parallel between said end frame members and along which a print head carriage runs, a substantially vertical slot in each end frame member in which said adjustable shaft is mounted for movement up and down within said slot and with respect to said end frame members, spring loading means for continuously biasing said shaft towards said guide member, a cam member on each end member mounted for rotation to adjust said shaft up and down within said slots;

said guide member is a rod running between said end members and in which said printer head carriage has a vertical slot through which said rod runs to enable said print head carriage to move up and down with respect to said rod when said adjustable shaft is moved;

said spring loading means comprises tension springs running between said rod and said shaft near the inside of said end frame members in order to be out of the way of movement of said print head carriage;

said cam member having a handle thereon for rotation thereof and the end of said handle has a projection substantially perpendicular thereto for insertion into one of a series of holes in said end members around the direction of rotation of said cam member to provide for fixed adjustment increments; and a shoulder screw is provided in each end member around which said cam member may be rotted and a spring washer is provided between the head of said screw and said cam member for biasing the handle toward said end member and said projection on the end of said handle into one of said holes.

2. An adjustable shaft mechanism for adjusting the gap between a print head and a platen in a dot matrix printer comprising in combination:

a printer frame having two end frame members, a fixed guide member and an adjustable shaft running substantially parallel between said end frame members and along which a print head carriage runs, a substantially vertical slot in each end frame member in which said adjustable shaft is mounted for movement up and down within said slot and with respect to said end frame members, spring loading means for continuously biasing said shaft toward said guide member, a cam member on each end member mounted for rotation to adjust said shaft up and down within said slots;

said guide member is a rod running between said end members and in which said printer head carriage has a vertical slot through which said rod runs to enable said print head carriage to move up and down with respect to said rod when said adjustable shaft is moved;

said spring loading means comprises hairpin springs mounted on the outside of said end frame members;

said cam member having a handle thereon for rotation thereof and the end of said handle has a projection substantially perpendicular thereto for insertion into one of a series of holes in said end members around the direction of rotation of said cam member to provide for fixed adjustment increments; and a shoulder screw is provided in each end member around which said cam member may be rotated and a spring washer is provided between the head of said screw and said cam member for biasing the handle toward said end member and said projection on the end of said handle into one of said holes.

* * * * *